US007040773B1

(12) United States Patent
Zincone et al.

(10) Patent No.: US 7,040,773 B1
(45) Date of Patent: May 9, 2006

(54) SELF CONTAINED AND POWERED TRAFFIC SIGNAL USING NATURAL AND ARTIFICIAL LIGHT

(76) Inventors: Robert Zincone, 26 Tera Nova Cir., Westport, CT (US) 06880; James V. Masi, 242 Spurwink Ave., Cape Elizabeth, ME (US) 04107-9612

( * ) Notice: Subject to any disclaimer, the term of this patent is extended or adjusted under 35 U.S.C. 154(b) by 0 days.

(21) Appl. No.: 11/015,942

(22) Filed: Dec. 17, 2004

Related U.S. Application Data

(60) Provisional application No. 60/531,773, filed on Dec. 22, 2003.

(51) Int. Cl.
*F21V 19/04* (2006.01)
*F24J 2/04* (2006.01)

(52) U.S. Cl. ..... 362/20; 362/192; 362/231; 362/293; 362/183; 126/600

(58) Field of Classification Search ..... 362/1, 362/20, 183, 192, 293, 231; 126/600; 136/246; 116/63 R
See application file for complete search history.

(56) References Cited

U.S. PATENT DOCUMENTS 5,032,963 A 7/1991 Granstrom ..... 362/337
5,174,649 A 12/1992 Alston ..... 362/244
5,457,450 A 10/1995 Deese et al. ..... 340/912
5,716,442 A * 2/1998 Fertig ..... 136/246
6,086,218 A 7/2000 Robertson ..... 362/157
6,107,941 A * 8/2000 Jones ..... 340/915
6,398,399 B1 6/2002 Neophytou ..... 362/576
6,599,002 B1 7/2003 Hsieh et al. ..... 362/555
6,895,145 B1 * 5/2005 Ho ..... 385/35

* cited by examiner

*Primary Examiner*—Ali Alavi
(74) *Attorney, Agent, or Firm*—Fattibene & Fattibene; Paul A. Fattibene; Arthur T. Fattibene

(57) ABSTRACT

An traffic light capable of utilizing both natural sunlight and artificial light for illuminating selective traffic signals. Natural light is directed to a natural light router or switch and to a color switch for providing a red, amber or yellow, and a green light for each bank of traffic light signals. A controller is coupled to the natural light router and light emitting diodes for controlling the mode of operation for operating the traffic light with either electrically powered light emitting diodes or with natural light collected by the natural light collector. A sensor detects the adequacy of the natural light, and when insufficient, causes the controller to power an LED signal light. The natural light may either be amplitude modulated or time modulated so as to provide a desired high illumination output to the desired signal light. The power consumption is greatly reduced, as well as providing a more reliable traffic light substantially independent of power line interruptions or fluctuations. Any information, not only traffic signals, may be displayed.

32 Claims, 5 Drawing Sheets

SELF CONTAINED AND POWERED TRAFFIC SIGNAL USING NATURAL AND ARTIFICIAL LIGHT

RELATED APPLICATION

This application claims priority on U.S. Provisional Patent Application No. 60/531,773, filed Dec. 22, 2003, which is herein incorporated by reference in its entirety.

FIELD OF THE INVENTION

The present invention relates in general to a self contained traffic signal or light, and more particularly to a traffic light using natural light in combination with light emitting diodes to illuminate the signal lights.

BACKGROUND OF THE INVENTION

Traffic lights are routinely used to control traffic along roadways and intersections. These traffic lights are often required to be powered by line voltage supplied by overhead wires. These traffic lights, while individually not requiring substantial amounts of power to illuminate the individual traffic signals, in total relatively large amounts of electrical power is used in the illumination of the traffic lights. Recently, there has been much development in traffic lights utilizing light emitting diodes rather than other forms of incandescent illumination. While the light emitting diodes are relatively efficient and have a relatively long life, during daylight hours it is often difficult for a light emitting diode to generate sufficient illumination to be clearly visible. There have been many efforts to aid in making more visible the illumination from a traffic signal utilizing light emitting diodes.

One such light emitting diode signal light is disclosed in U.S. Pat. No. 6,599,002 issuing to Hsieh et al on Jul. 29, 2003 and entitled "LED Signal Light". Therein disclosed is a light emitting diode signal light using a plurality of lens cells. The plurality of lens cells is used to redistribute the light in vertical and horizontal directions and adjust orientation of light to the specified illumination areas.

Another effort to enhance light emitting diode illumination, which may be used in a traffic light, is disclosed in U.S. Pat. No. 5,174,649 issuing to Alston on Dec. 29, 1992 and entitled "LED Lamp Including Refractive Lens Element". Therein disclosed are a plurality of facets that allow a large area on the lamp to appear to viewers to be uniformly illuminated.

In addition to the problems associated with the use of LED lights, there is also a problem of power interruptions or reduced line voltage which reduces the light emitting diode output. One solution to reduced light emitting diode illumination caused by interruptions in line voltage is disclosed in U.S. Pat. No. 5,457,450 issuing to Deese et al on Oct. 10, 1995 and entitled "LED Traffic Signal Light With Automatic Low-Line Voltage Compensating Circuit". Therein disclosed is a traffic light or signal using LED lights with a voltage compensating circuit that disables or re-engages a first and then a second set of LEDs in a traffic light as the input power voltage drops below a first and then a second threshold voltage. This results in the remaining LEDs being driven by an increased current, resulting in a greater light intensity.

While these prior patents disclose enhancements to LED traffic lights, there is a continuing need to improve LED traffic lights so as to be more visible and to conserve power.

Additionally, there is a strong safety concern to develop a signal light that can function even during interruptions in line voltage or power.

SUMMARY OF THE INVENTION

The present invention relates to a traffic light that is self contained and utilizes both natural light and artificial light for efficiently illuminating traffic signals that have the capability of operating with little electrical power and independently during blackouts or when external power is not available. Collected natural light is time modulated and routed to a plurality of color separator switches, one color separator switch is used for each bank of signal lights on each side of the traffic light. The color separator switch divides the time modulated natural light into time modulated separate colors of red, amber or yellow, and green, which are directed to the respective signal lights with fiber optics. A sensor detects when sufficient natural light is not available and causes independent light emitting diode lights to be used in lighting the traffic signals. Photovoltaic cells are used to charge a re-chargeable battery. The battery is used to provide power to the electronic systems for controlling the natural lighting portion of the traffic light and for providing power to the light emitting diodes when natural light is not available.

It is an object of the present invention to provide a traffic light that is efficient and requires substantially less power than prior traffic lights.

It is another object of the present invention to provide a traffic light that can operate during power interruptions or outages.

It is an advantage of the present invention that it is substantially self-contained.

It is another advantage of the present invention that it requires less maintenance.

It is a feature of the present invention that the natural light is time modulated so that substantially all of the illumination intensity of the natural light is utilized by each traffic signal light at a different time providing the brightest possible perceived illumination.

It is another feature of the present invention that light emitting diodes or LEDs are used.

These and other objects, advantages, and features will become more readily apparent in view of the following more detailed description.

DETAILED DESCRIPTION OF THE PREFERRED EMBODIMENTS

Figure 1:
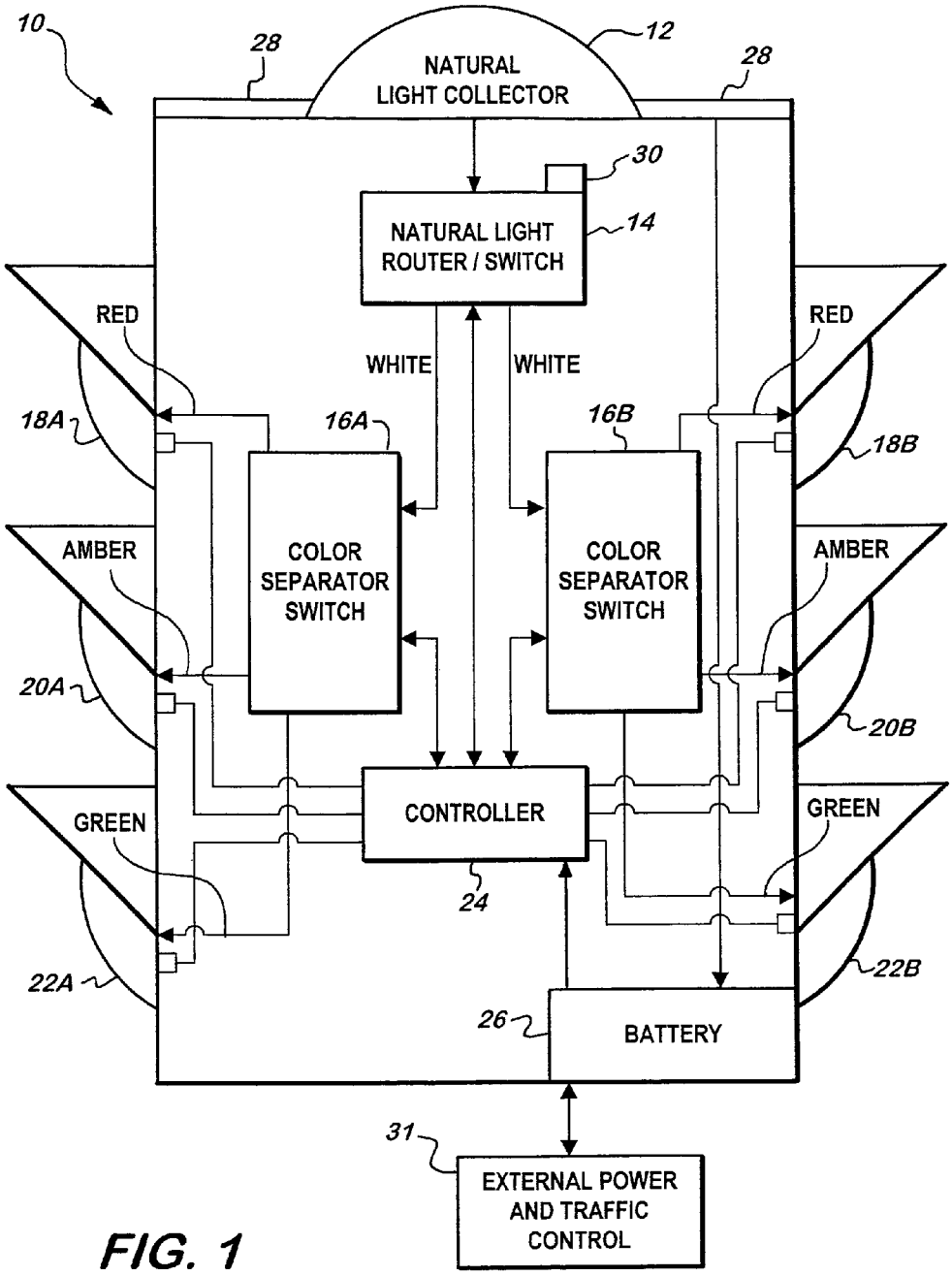
FIG. 1 schematically illustrates a traffic light according to the present invention.

FIG. 1 schematically illustrates a traffic light 10 according to an embodiment of the present invention. The traffic light 10 comprises a natural light collector 12 for collecting natural light. The natural light collector 12 may be any type of lens for collecting, concentrating, and directing natural light. For example, the natural light collector may be a Fresnel lens dome having a diameter of approximately nine inches or 23 cm. The natural light collector may be sized to acquire sufficient light on an overcast day to provide sufficient energy to illuminate at least four traffic signals. The collected light is directed to any light conductor, such as a fiber optic, to a natural light router and switch 14. The natural light router and switch 14 redirects or routes the natural light to different banks of signal lights for directing traffic. Each bank of signal lights typically would have red, amber or yellow, and green signal lights for directing traffic. The wavelength of the red light is approximately 624 nm, the wavelength of the amber or yellow light is approximately 588 nm, and the wavelength of the green light is approximately 505 nm. The natural light router or switch 14 time modulates the natural light such that the full intensity of the collected natural light is directed for short periods of time to each of the different banks of signal lights. The natural light or white light is directed through fiber optics from the natural light router and switch 14 to a plurality of color separator switches 16A and 16B, each associated with a bank of signal lights. The color separator switch 16A separates and further time modulates the three different colors, red, amber or yellow, and green, used to provide illumination for the traffic signal. The different colors for each of the traffic light signals are modulated so that the collected natural light is not split, preventing the amplitude or intensity from being reducing. The full intensity of the natural light that is collected is utilized to provide a bright traffic signal light, but for a relatively short duration. However, when the time modulation is such that the duration of the relatively bright intensity light traffic signal occurs sufficiently rapidly, an observer viewing the traffic signal cannot detect the flicker or modulation due to the natural retinal retention of the light receptors in the human eye.

The color separator switches 16A and 16B provide a different color to each of the different signal lights, such as the red lights 18A and 18B and the amber or yellow lights 20A and 20B and the green lights 22A and 22B. The color separator switches 16A and 16B may be any conventional color separator, such as an LCD color switch, prism, or dichroic mirror. The color separator switches 16A and 16B are coupled to a controller 24. The controller 24 is also coupled to the natural light router and switch 14 which therethrough is coupled to a light sensor 30. The controller 24 is used to properly sequence the time modulation of the natural or white light from the natural light router and switch 14 and for controlling the operation of the color separator switches 16A and 16B so that the natural or white light entering from the natural light router and switch 14 can be separated into the different colors red, amber or yellow, and green, as well as time modulating for directing the different colors to their respective signal lights for sequencing the required color signal. The rechargeable battery 26 provides power to the controller 24. The controller 24 is also coupled directly to the different colored signal lights 18A through 22B for controlling light emitting diodes that provide the illumination for the signal lights 18A–22B when natural light is not available or sufficient to provide the required intensity illumination to the signal lights 18A, 20A, 22A, and 18B, 20B, and 22B. The light sensor or detector 30 is used to determine when the natural light is insufficient, requiring the light emitting diodes or LEDs to be used. The controller 24 may also be connected through the battery 26 to an external power and traffic control 31. The external power and traffic control 31 provides external power when required during extended overcast days or when there is insufficient natural light for long periods of time, in addition to providing any traffic control signals that may be used to coordinate different traffic lights from a central location. The battery 26 may be charged by photovoltaic cells 28.

Figure 2A:
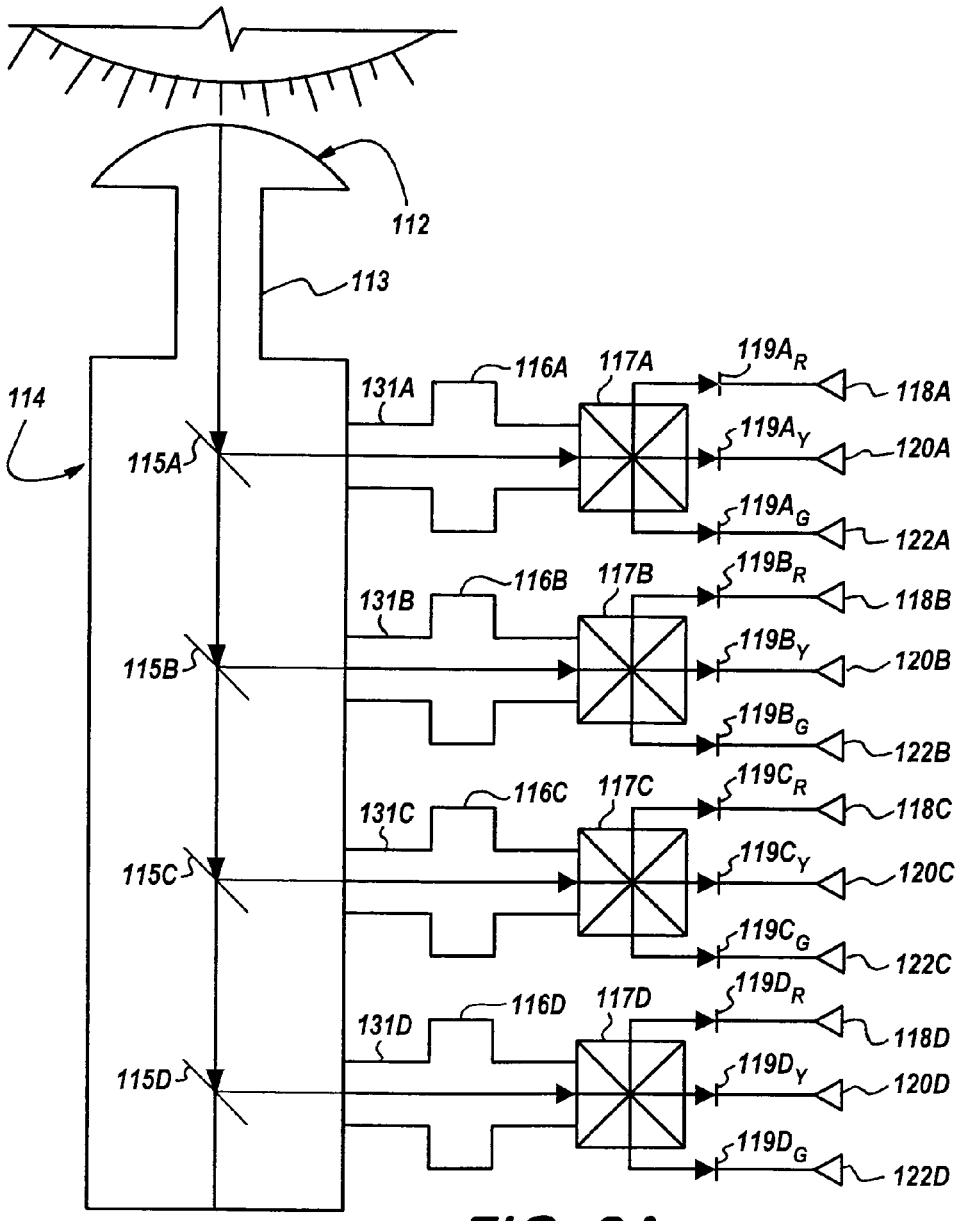
FIG. 2A schematically illustrates the optical path of the collected natural light of an embodiment of the present invention.

FIG. 2A schematically illustrates in more detail the operation of an embodiment of the natural light collection and traffic signal illumination system. The natural light is collected by natural light collector 112, which directs the natural light through fiber optics 113 to a natural light valve, switch, or router 114. The different channels of the output of the natural light valve, switch, or router 114 are directed to color switches 116A, 116B, 116C, and 116D through fiber optics 131A, 131B, 131C, and 131D. Partially reflective mirrors 115A, 115B, 1115C, and 115D may be used to redirect the natural light. Prism beamsplitters may also be used, or any other known optical device. While only four color switches 116A, 116B, 116C, and 116D are illustrated, it should be readily apparent that additional color switches may be used, depending on the number of sets of traffic light signals used for a particular application. Typically, in a four-way intersection there are four sets or banks of traffic signal lights, one for each side of the traffic signal or for each road, as illustrated in FIG. 2A.

The color switches 116A, 116B, 116C, and 116D divide the natural white light into three different colors, red, amber or yellow, and green. The color switches 116A, 116B, 116C, and 116D may be liquid crystal display or LCD color switches. The three different colors are separated or modulated in time so as to provide the different colors red, amber or yellow, and green at full intensity for only a relatively short time or duration. The time separated or modulated distinct colors are split or separated for each channel or bank by a dichroic beamsplitter 117A, 117B, 117C, and 117D and directed through fiber optics to each of the respective traffic signal lights. For example, the red light signals 118A, 118B, 118C, and 118D; the amber or yellow light signals 120A, 120B, 120C, and 120D; and the green light signals 122A, 122B, 122C, and 122D. A liquid crystal display or LCD switch 119$A_R$, 119$A_Y$, 119$A_G$, 119$B_R$, 119$B_Y$, 119$B_G$, 119$C_R$, 119$C_Y$, 119$C_G$, 119$D_R$, 119$D_Y$, 119$D_G$ may also be utilized to control the on and off of the different red, amber or yellow, and green colored illumination for each bank of signal lights, respectively.

Figure 2B:
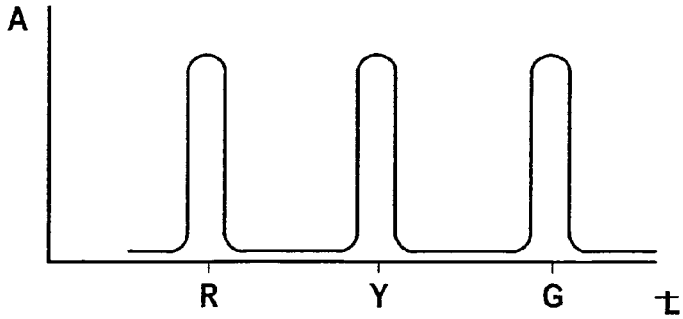
FIG. 2B graphically illustrates the amplitude of the colored light as a function of time.

FIG. 2B graphically illustrates the intensity or amplitude A of the three different colors, red, amber or yellow, and green as a function of time t. Each of the three different colors used for the signal light are modulated in time by each of the color switches 116A, 116B, 116C, and 116D for each respective channel. The graph in FIG. 2B represents the light after emerging from each of the respective color switches 116A, 116B, 116C, and 116D.

The embodiment illustrated in FIGS. 2A and 2B has the advantage of providing the red, amber or yellow, and green colored light to the respective light signal in each bank of signals. However the natural light received by the natural light collector 113 is divided in amplitude or intensity by the natural light router or switch 114 effectively reducing the available intensity of illumination for each bank of light signals. This may result in the illuminated signal in each bank to appear dimmer than desired.

Figure 2C:
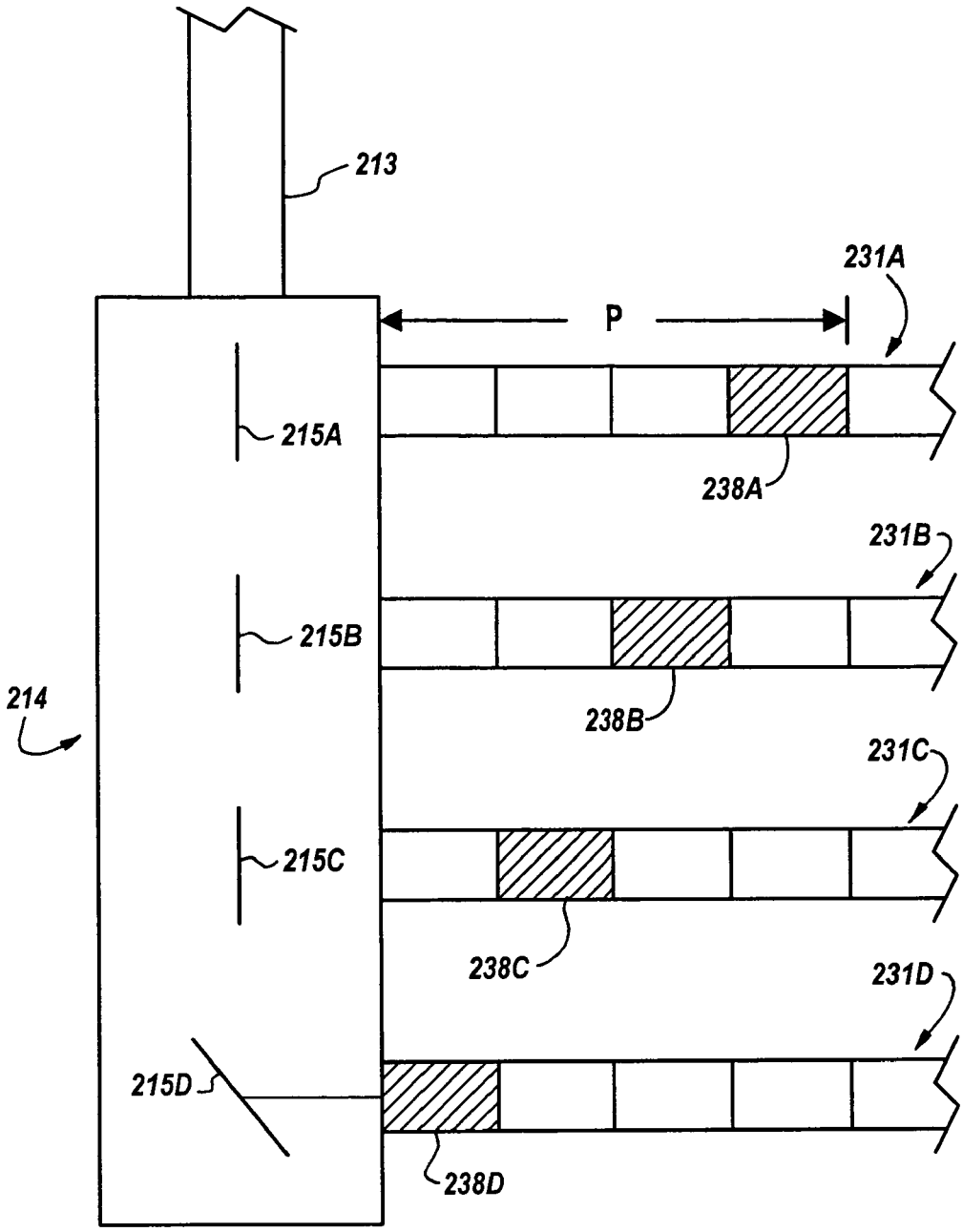
FIG. 2C schematically illustrates the optical path of the collected natural light of another embodiment of the present invention.

FIG. 2C schematically illustrates another embodiment of a natural light router or switch 214. In this embodiment, the natural light router or switch 214 modulates the natural light in time rather than intensity or amplitude. The fiber optic 213 directs natural light from a collector to the natural light router or switch 214. By way of example, the natural light router or switch 214 may be comprised of a plurality of movable mirrors 215A, 215B, 215C, and 215D. Mirrors 215A, 215B and 215C are positioned initially so as to permit light to pass and strike angled mirror 215D. Mirror 215D directs substantially all of the natural light to a fiber optic 231D. The directed natural light is represented by a light packet 238D having a predetermined duration. The mirrors 215A, 215B, 215C and 215D selectively and sequentially at predetermined times redirect the natural illumination received by the fiber optic 213 through the fiber optics 231A, 231B, 231C and 231D. Accordingly, sequential light packets 238A, 238B, 238C, and 238D are formed with a combined period P. The light packet sequence and period P are repeated. While a plurality of movable mirrors have been illustrated for redirecting the natural light into a plurality of channels, any other known optical means for redirecting light may be used.

In this embodiment, the light amplitude or intensity is not split and the entire light amplitude or intensity is used for each light packet 238A–D. However, each light packet 238A–D has a duration of only one-quarter of the period P. The duration of each light packet may be selected so as to take advantage of a characteristic of the human eye. Generally, the human eye cannot detect flashing above about twenty Hertz. The human eye generally perceives any flashing above about twenty Hertz as a continuous illumination. Accordingly, the incoming light in this embodiment is sequentially and equally split or divided into four channels. Each of the four channels has a light packet that carries one hundred percent of the light intensity. In this way, all four channels have one hundred percent of the light intensity available, but for only one-quarter of the time. By properly selecting the duration of the light packet or its frequency, the human eye will detect a continuous illumination. If a frequency of forty Hertz is selected, each channel or light packet will result in fifty milliseconds of light, which is repeated at forty Hertz. The one hundred percent intensity at a duration of fifty milliseconds at a frequency of forty Hertz should present itself as a continuous light intensity to the human eye. Therefore, the light signal perceived by the human viewer should appear relatively bright and be steady or continuous. It is possible to optimize this frequency to establish the highest light retention to be produced.

Figure 3:
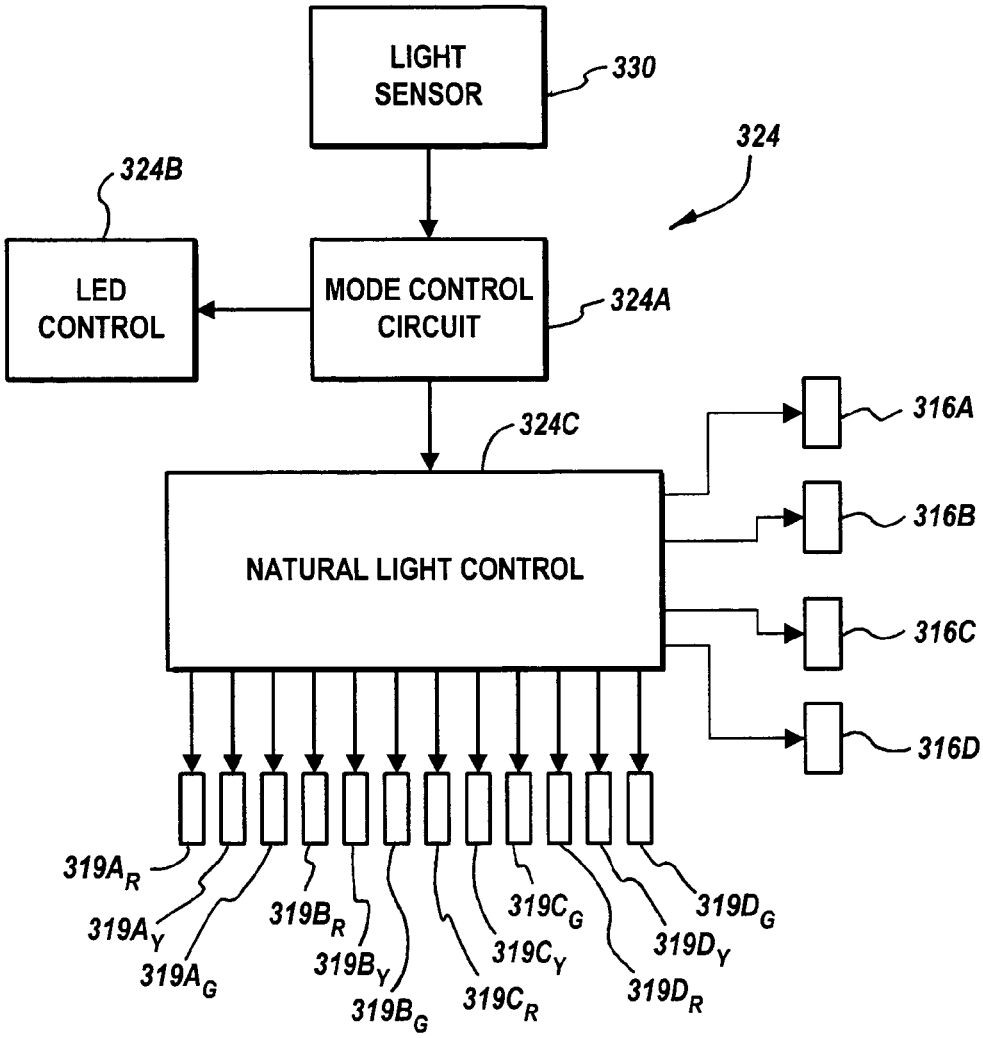
FIG. 3 schematically illustrates an electronic controller used for controlling the electronic components of the traffic signal of the present invention.

FIG. 3 schematically illustrates a control circuit used with the signal light that may be utilized to switch between or select operation in a light emitting diode mode or a natural light mode. The control selection circuitry 324 may consist of a light sensor 330 coupled to a mode control circuit 324A. The mode control circuit 324A will pass control to an LED control 324B or a natural light control 324C, depending upon the output of the light sensor 330. When there is insufficient natural light or illumination, the light sensor 330 provides a signal to the mode control circuit 324A. The mode control circuit 324A then directs the LED controller 324B to use the LEDs to illuminate the light signals in the traffic light. However, when the light sensor 330 detects sufficient natural light to illuminate the light signals in the traffic light, the light sensor 330 provides a signal to the mode control circuit 324A wherein the mode control circuit 324A directs the LED control 324B not to provide signal illumination to the traffic signal LEDs and directs the natural light control 324C to provide the natural light illumination to the light signals of the traffic light. The natural light control 324C controls the color switches 316A, 316B, 316C, and 316D on each of the four sides or banks of light signals of the traffic light. The natural light control 324C also controls the LCD switches 319$A_R$, 319$A_Y$, 319$A_G$, 319$B_R$, 319$B_Y$, 319$B_G$, 319$C_R$, 319$C_Y$, and 319$C_G$, 319$D_R$, 319$D_Y$, 319$D_G$. The natural light control therefore controls the release of natural light to illuminate selectively each of the three different colors on the four different sides of a traffic light. The control selection circuit 324 may be utilized with the amplitude controlled natural light router or switch 114 illustrated in FIG. 2A or the time controlled or modulated natural light router or switch 214 illustrated in FIG. 2C.

The control selection circuit 324 may be used to selectively control the use of natural light when it is sufficient or when it is insufficient, the light emitting diodes may be used to illuminate the traffic signals in the traffic light. The control selection circuit 324 may easily be made form conventional circuits, for example field programmable gate arrays, FPGA, or application specific integrated circuits, ASIC. The software to operate the traffic light may be application specific and interface with conventional traffic light control software.

Figure 4:
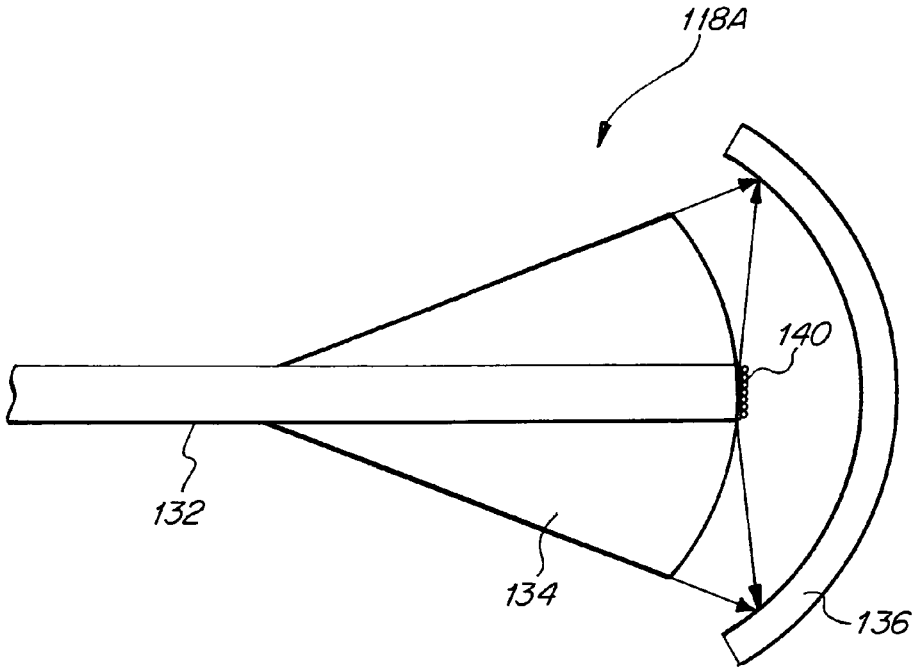
FIG. 4 is a side elevational view schematically illustrating a hybrid illuminating unit comprising a light emitting diode and fiber optic light bundle used in the present invention.
Figure 5:
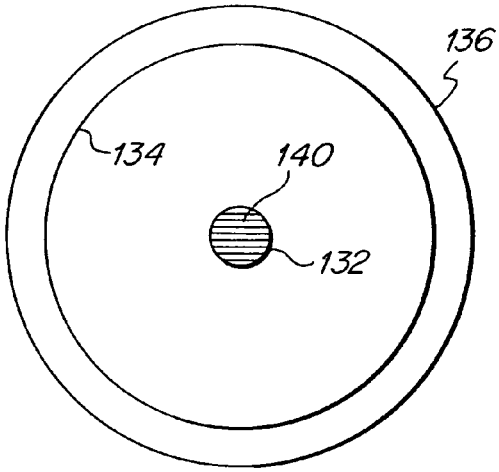
FIG. 5 is a front elevational view schematically illustrating the hybrid illuminating unit illustrated in FIG. 4.

FIGS. 4 and 5 illustrate a single hybrid light emitting diode and natural light illumination cell or unit 118A. It will be appreciated that a plurality or an array of these hybrid illumination units 118A may be utilized for any light signal and for each color signal. The hybrid illumination unit or cell 118A comprises a fiber optic bundle 132 that carries natural light illumination received by collector 112, illustrated in FIG. 2A. A light emitting diode 134 is coupled to a light emitting diode control, such as that illustrated in FIG. 3 as LED control 324B, so as to be selectively illuminated when needed. The light emitting diode 134 has a hole or opening therein that permits the fiber optic bundle 132 to pass therethrough. At the end of the fiber optic bundle 132, adjacent the emitting surface of a light emitting diode 134, is placed a lenticular lens 140. Adjacent the lenticular lens 140 and the light emitting diode 134 is a lens 136. The lenticular lens 140 spreads the light from the fiber optic bundle 132 to fill the lens 136. An array of the hybrid illumination units 118A are utilized for each of the light signals of the traffic light. Therefore, each of the hybrid illumination units 118A may be selectively illuminated by either the natural light within the fiber optic bundle 132 or by selectively energizing the LED 134 in order to illuminate the desired traffic signal of the traffic light.

While the preferred embodiment of the present invention is related to a traffic light having three colored lights, the term traffic light or signal may include other informational displays to control vehicles, pedestrians, or other things. For example, a traffic light may be defined as any informational display to control traffic, including pedestrian traffic such as a walk, don't walk display at a cross walk, train signals, traffic information displays, and any other illuminated display.

Additionally, while the preferred embodiment of the present invention has been described with respect to a traffic light, the present invention may by embodied in any informational display having a plurality of illuminated information signals forming words or symbols to convey any desired information. For example, rather than information related to traffic signals, the present invention may be used to display any information such as news, warnings, weather, advertising, or any other information wishing to be conveyed to an individual through an illuminated display.

While several different embodiments of the present invention have been illustrated and described, it will be obvious to those skilled in the art that various modifications may be made without departing from the spirit and scope of this invention.

What is claimed is:

1. A natural and artificial light operated traffic light comprising:

a natural light collector;

a natural light router coupled to said natural light collector, said natural light router selectively directing natural light from said natural light collector to a predetermined traffic signal;

an electric light, said electric light capable of illuminating the predetermined traffic signal; and a controller coupled to said natural light router and said electric light, said controller controlling the illumination of the predetermined traffic signal, whereby the predetermined traffic signal of the natural and artificial light operated traffic light is capable of being selectively illuminated by either natural light or said electric light.

2. A natural and artificial light operated traffic light as in claim 1 wherein:

said electric light comprises a light emitting diode.

3. A natural and artificial light operated traffic light as in claim 1 further comprising:

means, coupled to said natural light router, for separating the natural light into wavelengths substantially in the red, amber or yellow, and green spectrum.

4. A natural and artificial light operated traffic light as in claim 1 wherein:

said natural light router comprises a beamsplitter router, wherein said beamsplitter router divides the natural light from said natural light collector into a plurality of light channels for illuminating a different traffic signal.

5. A natural and artificial light operated traffic light as in claim 1 wherein:

said natural light router comprises a time modulated router, wherein said time modulated router modulates in time the natural light from said natural light collector into a plurality of light channels for illuminating a different traffic signal for a predetermined duration.

6. A natural and artificial light operated traffic light as in claim 5 wherein:

said time modulated router modulates illumination at greater than twenty Hertz, whereby to a human observer the modulated illumination appears as continuous illumination.

7. A natural and artificial light operated traffic light as in claim 6 wherein:

said time modulated router modulates illumination at forty Hertz.

8. A natural and artificial light operated traffic light as in claim 4 further comprising:

a color switch coupled to each of the plurality of light channels, said color switch separating the natural light into three colors.

9. A natural and artificial light operated traffic light as in claim 8 wherein:

the three colors comprise red, amber or yellow, and green.

10. A natural and artificial light operated traffic light as in claim 2 wherein:

said light emitting diode has a hole, and further comprising a fiber optic bundle placed through the hole in said light emitting diode, whereby natural light passing through said fiber optic bundle is capable of illuminating the predetermined traffic signal.

11. A natural and artificial light operated traffic light as in claim 1 further comprising:

a photovoltaic cell; and a rechargeable battery coupled to said photovoltaic cell.

12. A natural and artificial light operated traffic light as in claim 1 wherein:

said natural light collector comprises a Fresnel lens.

13. A natural and artificial light operated traffic light as in claim 12 further comprising:

a fiber optics bundle coupled between said Fresnel lens and said natural light router.

14. A natural and artificial light operated traffic light as in claim 1 wherein:

the traffic light is coupled to a central traffic control.

15. A natural and artificial light traffic light comprising:

a plurality of electric lights forming a plurality of traffic signals;

a natural light collector, whereby sunlight is collected;

a natural light router coupled to said natural light collector;

a color separator switch coupled to said natural light router;

fiber optics coupled between said color separator switch and each of said plurality of traffic signals, whereby a predetermined colored illumination is capable of being provided to each of said plurality of traffic signals; and a mode controller coupled to said natural light router and said plurality of electric lights, wherein said mode controller selectively controls the illumination of the plurality of electric lights and the routing of the natural light depending upon the amount of natural light available to illuminate each of the plurality of traffic signals, whereby each of the plurality of traffic signals is capable of being illuminated by natural light or the plurality of electric lights.

16. A natural and artificial light traffic light as in claim 15 wherein:

said plurality of electric lights comprises light emitting diodes.

17. A natural and artificial light traffic light as in claim 15 wherein:

said natural light router comprises a beamsplitter.

18. A natural and artificial light traffic light as in claim 15 wherein:

said natural light router comprises means for time modulating the natural light.

19. A natural and artificial light traffic light as in claim 15 wherein:

the traffic light is coupled to a central traffic control.

20. A natural and artificial light operated traffic light having a plurality of individual traffic signals comprising:

a plurality of light emitting diode arrays, each of said plurality of light emitting diode arrays illuminating one of the plurality of individual traffic signals;

a natural light collector;

a natural light router coupled to said natural light collector, said natural light router selectively directing natural light from said natural light collector;

a first plurality of fiber optic bundle channels coupled to said natural light router, each of said first plurality of fiber optic bundles receiving selectively directed natural light from said natural light router;

means, coupled to each of said first plurality of fiber optic bundle channels, for separating the natural light into wavelengths substantially in the red, amber or yellow, and green spectrum; a second plurality of fiber optic bundles coupled to said means for separating the natural light into wavelengths substantially in the red, amber or yellow, and green spectrum, each of said second plurality of fiber optic bundles directing light of one of the red, amber or yellow, and green spectrum to a selected one of the plurality of individual traffic signals; and a controller coupled to said means for separating the natural light into wavelengths substantially in the red, amber or yellow, and green spectrum and said plurality of light emitting diode arrays, said controller controlling the illumination of each of the plurality of individual traffic signals, whereby a predetermined traffic signal is capable of being selectively illuminated by either natural light or one of said plurality of light emitting diode arrays.

21. A natural and artificial light operated traffic light having a plurality of individual traffic signals as in claim 20 wherein:

said natural light router comprises means for modulating in time the natural light.

22. A natural and artificial light operated traffic light having a plurality of individual traffic signals as in claim 21 wherein:

the modulating in time comprises a modulation above twenty Hertz, whereby to a human observer the modulated illumination appears as continuous illumination.

23. A natural and artificial light operated traffic light having a plurality of individual traffic signals as in claim 20 wherein:

said natural light router comprises means for splitting the natural light into a plurality of channels.

24. A natural and artificial light operated traffic light having a plurality of individual traffic signals as in claim 20 further comprising:

a photovoltaic cell; and a rechargeable battery coupled to said photovoltaic cell.

25. A natural and artificial light operated traffic light having a plurality of individual traffic signals as in claim 20 wherein:

the traffic light is coupled to a central traffic controller.

26. A self contained, independently powered and operated natural and artificial light operated traffic light comprising:

a natural light collector;

a natural light router coupled to said natural light collector, said natural light router selectively directing natural light from said natural light collector to a predetermined traffic signal;

an electric light, said electric light capable of illuminating the predetermined traffic signal; and a controller coupled to said natural light router and said electric light, said controller controlling the illumination of the predetermined traffic signal;

a battery coupled to said controller; and a photovoltaic cell coupled to said battery, whereby the predetermined traffic signal of the natural and artificial light operated traffic light is capable of being selectively illuminated by either natural light or said electric light without a connection to a power line.

27. A natural and artificial light operated informational display comprising:

a natural light collector;

a natural light router coupled to said natural light collector, said natural light router selectively directing natural light from said natural light collector to a predetermined information signal;

an electric light, said electric light capable of illuminating the predetermined information signal; and a controller coupled to said natural light router and said electric light, said controller controlling the illumination of the predetermined information signal, whereby the predetermined information signal of the natural and artificial light operated informational display is capable of being selectively illuminated by either natural light or said electric light.

28. A natural and artificial light operated informational display as in claim 27 wherein:

said electric light comprises a light emitting diode.

29. A natural and artificial light operated informational display as in claim 27 wherein:

said natural light router comprises a beamsplitter router, wherein said beamsplitter router divides the natural light from said natural light collector into a plurality of light channels for illuminating a predetermined plurality of information signals.

30. A natural and artificial light operated informational display as in claim 27 wherein:

said natural light router comprises a time modulated router, wherein said time modulated router modulates in time the natural light from said natural light collector into a plurality of light channels for illuminating a predetermined plurality of information signals for a predetermined duration.

31. A natural and artificial light operated informational display as in claim 30 wherein:

said time modulated router modulates illumination at greater than twenty Hertz, whereby to a human observer the modulated illumination appears as continuous illumination.

32. A natural and artificial light operated informational display as in claim 31 wherein:

said time modulated router modulates illumination at forty Hertz.

* * * * *